US010247029B2

(12) United States Patent
Philbrick et al.

(10) Patent No.: US 10,247,029 B2
(45) Date of Patent: Apr. 2, 2019

(54) METHOD FOR CLEARANCE CONTROL IN A GAS TURBINE ENGINE

(71) Applicant: United Technologies Corporation, Farmington, CT (US)

(72) Inventors: Graham Ryan Philbrick, Durham, CT (US); Allison Zywiak, Durham, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 493 days.

(21) Appl. No.: 15/015,667

(22) Filed: Feb. 4, 2016

(65) Prior Publication Data

US 2017/0226886 A1 Aug. 10, 2017

(51) Int. Cl.

| | |
|---|---|
| ***F01D 11/22*** | (2006.01) |
| ***F01D 5/12*** | (2006.01) |
| ***F01D 25/24*** | (2006.01) |
| ***F04D 29/052*** | (2006.01) |
| ***F04D 29/32*** | (2006.01) |

(Continued)

(52) U.S. Cl.

CPC ..... *F01D 11/22* (2013.01); *F01D 3/04* (2013.01); *F01D 5/12* (2013.01); *F01D 25/24* (2013.01); *F04D 29/052* (2013.01); *F04D 29/164* (2013.01); *F04D 29/321* (2013.01); *F04D 29/526* (2013.01); *F05D 2220/32* (2013.01);

(Continued)

(58) Field of Classification Search

CPC . F01D 11/22; F01D 5/12; F01D 25/24; F01D 11/20; F01D 11/025; F01D 11/14; F04D 29/052; F04D 29/321; F04D 29/526; F05D 2220/32; F05D 2260/30

USPC ..... 415/1

See application file for complete search history.

(56) References Cited

U.S. PATENT DOCUMENTS 1,797,810 A * 3/1931 Vogel ..... F04D 1/066 415/104

1,823,310 A * 9/1931 Allen ..... F01D 11/02 415/131

(Continued)

FOREIGN PATENT DOCUMENTS

| | | | |
|---|---|---|---|
| EP | 2206882 | A1 | 7/2010 |
| EP | 2206889 | A1 | 7/2010 |
| WO | 2010089198 | A2 | 8/2010 |

OTHER PUBLICATIONS

European Search Report for EP17153504, dated Jun. 13, 2017, 10 pages.

*Primary Examiner* — Jason D Shanske
*Assistant Examiner* — Brian Christopher Delrue
(74) *Attorney, Agent, or Firm* — Cantor Colburn LLP

(57) ABSTRACT

A gas turbine engine, system, and method with clearance control are provided. For example, the gas turbine engine includes a static component, and a rotating component that shifts axially in one of an aft direction and a forward direction in relation to the static component during a first operating condition of the gas turbine engine, and shifts axially in the other of the aft direction and the forward direction in relation to the static component during a second operating condition of the gas turbine engine. The first operating condition is when a rotating component growth and a static component growth change at different rates. The second operating condition is when the rotating component growth and static component growth normalize.

20 Claims, 7 Drawing Sheets

(51) Int. Cl.
*F04D 29/52* (2006.01)
*F01D 3/04* (2006.01)
*F04D 29/16* (2006.01)

(52) U.S. Cl.
CPC ..... *F05D 2240/52* (2013.01); *F05D 2260/30* (2013.01)

(56) References Cited

U.S. PATENT DOCUMENTS 1,827,682 A * 10/1931 Weidehoff ..... F01D 1/16 415/101
2,762,559 A * 9/1956 Faught ..... F01D 5/06 415/17
3,227,418 A * 1/1966 West ..... F01D 11/22 415/127
4,023,919 A * 5/1977 Patterson ..... F01D 11/18 415/134
4,466,239 A * 8/1984 Napoli ..... F01D 5/082 415/116
4,661,043 A * 4/1987 Groenendaal, Jr. ..... F01D 5/08 415/104
4,683,716 A * 8/1987 Wright ..... F01D 11/22 415/127
4,730,977 A * 3/1988 Haaser ..... F01D 3/00 415/104
4,864,810 A * 9/1989 Hines ..... F01D 3/04 415/105
4,865,529 A * 9/1989 Sutton ..... F04D 13/04 384/102
4,993,917 A * 2/1991 Kulle ..... F01D 3/04 277/361
5,012,420 A * 4/1991 Walker ..... F01D 11/24 415/1
5,102,237 A * 4/1992 Ide ..... F16C 17/035 384/224
5,154,048 A * 10/1992 Ponziani ..... F01D 3/04 415/107
5,267,435 A * 12/1993 Frenkel ..... F02C 9/28 60/204
5,658,125 A * 8/1997 Burns ..... F01D 11/22 415/1
6,705,086 B1 * 3/2004 Retzlaff ..... F01D 1/023 60/653
7,195,443 B2 * 3/2007 Vandervort ..... F01D 3/02 415/1
7,559,696 B2 * 7/2009 Oncina ..... F01D 3/04 384/100
8,011,883 B2 * 9/2011 Schwarz ..... F01D 11/20 415/127
8,147,178 B2 * 4/2012 Ottaviano ..... F02C 3/08 415/104
8,152,438 B2 * 4/2012 Servant ..... F01D 25/162 403/12
8,336,315 B2 * 12/2012 Bauer ..... F01D 11/14 60/782
9,239,006 B2 * 1/2016 Fritsch ..... F01D 9/06
9,341,073 B2 * 5/2016 Donnelly ..... F01D 3/04
9,951,643 B2 * 4/2018 Duguay ..... F01D 11/22
2002/0009361 A1 * 1/2002 Reichert ..... F01D 11/22 415/110
2002/0097928 A1 * 7/2002 Swinton ..... F01D 25/166 384/103
2004/0156567 A1 * 8/2004 Gozdawa ..... F16C 32/0644 384/100
2004/0223846 A1 * 11/2004 Taylor ..... F01D 11/14 415/200
2005/0109016 A1 * 5/2005 Ullyott ..... F01D 11/24 60/282
2005/0220610 A1 * 10/2005 Ghasripoor ..... F01D 5/225 415/173.3
2006/0140747 A1 * 6/2006 Vandervort ..... F01D 3/02 415/1
2007/0295402 A1 * 12/2007 Awtar ..... F01D 11/14 137/119.01
2008/0152477 A1 * 6/2008 Moniz ..... F04D 29/0513 415/110
2008/0213085 A1 * 9/2008 Deidewig ..... F01D 3/04 415/104
2008/0267769 A1 * 10/2008 Schwarz ..... F01D 11/20 415/148
2010/0083660 A1 * 4/2010 Nakhamkin ..... F02C 6/16 60/652
2010/0154433 A1 * 6/2010 Ottaviano ..... F02C 3/08 60/785
2011/0203275 A1 * 8/2011 Nishimoto ..... F01D 5/08 60/645
2012/0017592 A1 * 1/2012 Maruyama ..... F01D 3/04 60/645
2012/0167589 A1 * 7/2012 Fritsch ..... F01D 9/06 60/785
2013/0071242 A1 * 3/2013 Caprario ..... F02C 7/12 415/230
2015/0059350 A1 * 3/2015 Kolvick ..... F02C 3/34 60/772
2016/0305268 A1 * 10/2016 Duguay ..... F01D 11/14
2017/0074112 A1 * 3/2017 Philbrick ..... F02C 3/13
2017/0107839 A1 * 4/2017 Glahn ..... F01D 11/025
2017/0198583 A1 * 7/2017 Dean ..... F01D 1/32

* cited by examiner

METHOD FOR CLEARANCE CONTROL IN A GAS TURBINE ENGINE

BACKGROUND

The subject matter disclosed herein generally relates to clearance control between rotating and static components of a gas turbine engine and, more particularly, to thrust balance manipulation for clearance control.

Gas turbine engines, such as those used to power modern commercial and military aircrafts, generally include a compressor section to pressurize an airflow, a combustor section for burning hydrocarbon fuel in the presence of the pressurized air, and a turbine section to extract energy from the resultant combustion gases. The airflow flows along a gas path between components through the gas turbine engine.

Accordingly, a gas turbine engine includes a plurality of rotating components arranged along an axis of rotation of the gas turbine engine, in both the compressor section and the turbine section. The gas turbine engine also includes a number of static components. The rotating and static components of the gas turbine engine are made from many different materials and vary in size, thickness, and dimensions. Therefore, each component has a growth pattern that includes thermally and mechanically expanding and contracting at different rates. Such component growth during operation, if left unaccounted for, could cause rotating components of the gas turbine engine to undesirably come into contact with static components causing damage to the gas turbine engine.

Accordingly there is a desire to find a way to control the clearance distances between the rotating components and the static components of gas turbine engines.

SUMMARY

According to one embodiment a gas turbine engine with clearance control is provided. The gas turbine engine includes a static component, and a rotating component that shifts axially in one of an aft direction and a forward direction in relation to the static component during a first operating condition of the gas turbine engine, and shifts axially in the other of the aft direction and the forward direction in relation to the static component during a second operating condition of the gas turbine engine. The first operating condition is when a rotating component growth and a static component growth change at different rates. The second operating condition is when the rotating component growth and static component growth normalize.

In addition to one or more of the features described above, or as an alternative, further embodiments of the gas turbine engine may include wherein the rotating component increases a clearance distance between the rotating component and the static component by shifting axially in the first operating condition, and wherein the rotating component decreases the clearance distance between the rotating component and the static component by shifting axially in the second operating condition.

In addition to one or more of the features described above, or as an alternative, further embodiments of the gas turbine engine may include wherein a backward most position in the aft direction and a forward most position in the forward direction have a maximum separation distance defined by a thrust bearing freeplay distance.

In addition to one or more of the features described above, or as an alternative, further embodiments of the gas turbine engine may include wherein the static component growth and the rotating component growth each include a mechanical expansion value and a thermal expansion value.

In addition to one or more of the features described above, or as an alternative, further embodiments of the gas turbine engine may include a compressor that manipulates thrust balance within the compressor that shifts the rotating component axially.

In addition to one or more of the features described above, or as an alternative, further embodiments of the gas turbine engine may include thrust balance vents that vent certain parts of the compressor, wherein venting generates axial force within the compressor that shifts the rotating component axially.

In addition to one or more of the features described above, or as an alternative, further embodiments of the gas turbine engine may include wherein the compressor includes a plurality of rotating disks with a chamber between each of the plurality of rotating disks, and wherein the chamber on a forward side of each rotating disk has a lower pressure than the chamber on an aft side of each rotating disk that has a higher pressure.

In addition to one or more of the features described above, or as an alternative, further embodiments of the gas turbine engine may include a higher pressure chamber that axially shifts the rotating component in the aft direction when the higher pressure chamber is vented, and a lower pressure chamber that axially shifts the rotating component in the forward direction when the lower pressure chamber is vented.

According to one embodiment a system in a gas turbine engine for clearance control is provided. The system includes a gas turbine engine controller that generates a clearance control signal based on operating conditions of the gas turbine engine, wherein the control signal controls axial shifts within the system, a static component, and a rotating component that shifts axially in one of an aft direction and a forward direction in relation to the static component during a first operating condition of the gas turbine engine in response to receiving the clearance control signal, and shifts axially in the other of the aft direction and the forward direction in relation to the static component during a second operating condition of the gas turbine engine in response to receiving the clearance control signal. The first operating condition is when a rotating component growth and a static component growth change at different rates. The second operating condition is when the rotating component growth and static component growth normalize.

According to one embodiment a method for clearance control between a rotating component and a static component of a gas turbine engine is provided. The method includes shifting the rotating component axially in one of an aft direction and a forward direction in relation to the static component during a first operating condition of the gas turbine engine, wherein the first operating condition is when a rotating component growth and a static component growth change at different rates, determining that the first operating condition has ended and that the gas turbine engine is operating in a second operating condition during which the rotating component growth and static component growth normalize, and shifting the rotating component axially in the other of the aft direction and the forward direction in relation to the static component during the second operating condition.

In addition to one or more of the features described above, or as an alternative, further embodiments of the method may include wherein shifting the rotating component axially in the aft direction includes increasing a clearance distance between the rotating component and the static component, and wherein shifting the rotating component axially in the forward direction includes decreasing the clearance distance between the rotating component and the static component.

In addition to one or more of the features described above, or as an alternative, further embodiments of the method may include maintaining the clearance distance within a max threshold value and a minimum threshold value.

In addition to one or more of the features described above, or as an alternative, further embodiments of the method may include wherein a backward most position in the aft direction and a forward most position in the forward direction have a maximum separation distance defined by a thrust bearing freeplay distance.

In addition to one or more of the features described above, or as an alternative, further embodiments of the method may include wherein the rotating component includes a high spool that includes a compressor and a turbine.

In addition to one or more of the features described above, or as an alternative, further embodiments of the method may include wherein the static component growth and the rotating component growth each include a mechanical expansion value and a thermal expansion value.

In addition to one or more of the features described above, or as an alternative, further embodiments of the method may include wherein shifting the rotating component axially includes manipulating thrust balance in a compressor of the gas turbine engine.

In addition to one or more of the features described above, or as an alternative, further embodiments of the method may include wherein manipulating the thrust balance includes venting certain parts of the compressor using thrust balance vents, wherein venting generates axial force within the compressor that shifts the rotating component axially.

In addition to one or more of the features described above, or as an alternative, further embodiments of the method may include wherein the compressor includes a plurality of rotating disks with a chamber between each of the plurality of rotating disks, wherein a lower pressure is provided in the chamber on a forward side of each rotating disk and a higher pressure is provided in the chamber on an aft side of each rotating disk.

In addition to one or more of the features described above, or as an alternative, further embodiments of the method may include venting a higher pressure chamber by axially shifting the rotating component in the aft direction.

In addition to one or more of the features described above, or as an alternative, further embodiments of the method may include venting a lower pressure chamber by axially shifting the rotating component in the forward direction.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the present disclosure are apparent from the following detailed description taken in conjunction with the accompanying drawings in which.

DETAILED DESCRIPTION

Figure 1:
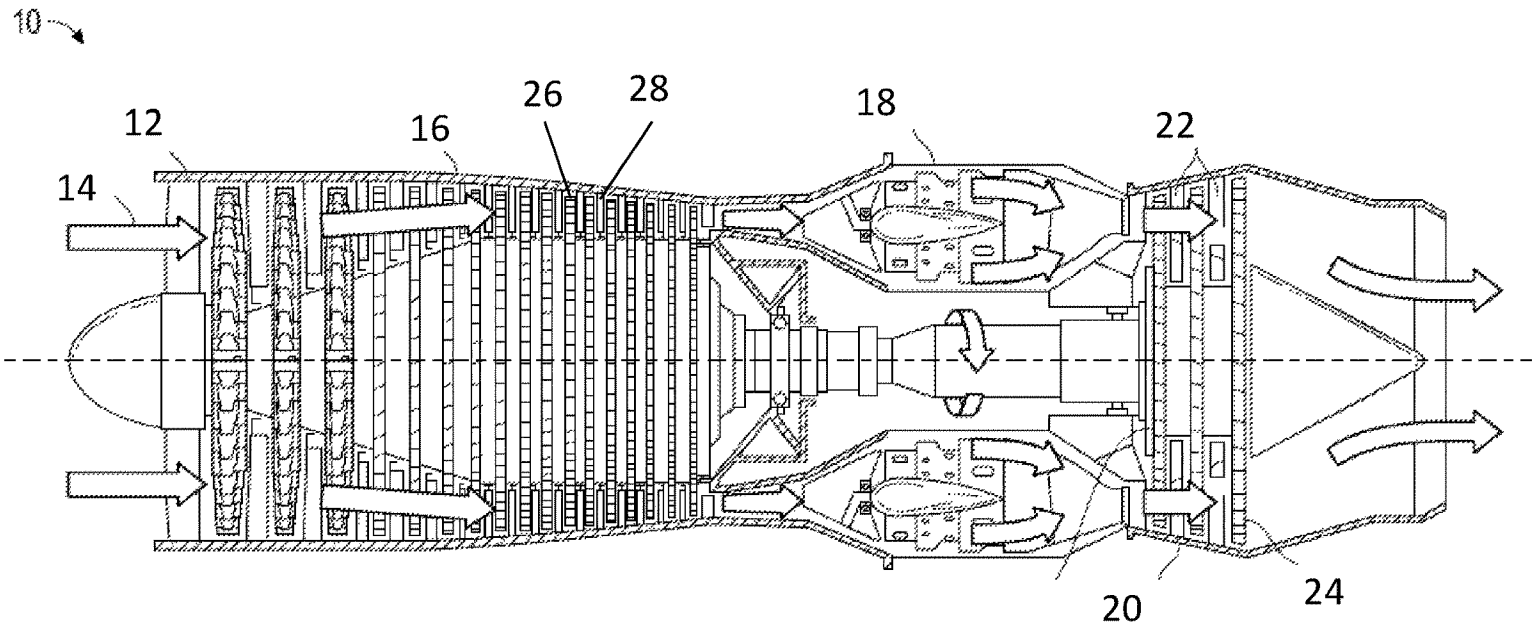
FIG. 1 illustrates a schematic cross-sectional view of a gas turbine engine in accordance with one or more exemplary embodiments.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Embodiments described herein are directed to a method and system for clearance control between a rotating component and a static component of a gas turbine engine. Specifically, according to an embodiment, mechanical growth of components can occur in orders of magnitude faster than thermal growth. Thus, a system as disclosed herein utilizes a sloped flow path and a thrust balance valve that allows additional clearance during initial transient periods and clearance adjustments once thermals and mechanical growth values normalize.

For example, turning now to FIG. 1, a schematic cross-sectional view of a gas turbine engine is shown in accordance with one or more exemplary embodiments.

Specifically, FIG. 1 is a schematic illustration of a gas turbine engine 10. The gas turbine engine generally has a fan 12 through which ambient air is propelled in the direction of arrow 14, a compressor 16 for pressurizing the air received from the fan 12 and a combustor 18 wherein the compressed air is mixed with fuel and ignited for generating combustion gases.

The gas turbine engine 10 further includes a turbine section 20 for extracting energy from the combustion gases. Fuel is injected into the combustor 18 of the gas turbine engine 10 for mixing with the compressed air from the compressor 16 and ignition of the resultant mixture. The fan 12, compressor 16, combustor 18, and turbine 20 are typically all concentric about a common central longitudinal axis of the gas turbine engine 10. In some embodiments, the turbine 20 includes one or more turbine stators 22 and one or more turbine rotors 24. Likewise, the compressor 16 includes one or more compressor rotors 26 and one or more compressor stators 28. It is to be appreciated that while the description below relates to compressors 16 and compressor rotors 26, one skilled in the art will readily appreciate that the present disclosure may be utilized with respect to turbine rotors 24.

Further, according to one or more embodiments, during a transient period of operation different elements of the gas turbine engine can expand and contract due to, for example, rotational mechanical forces and thermal expansion. Further, the elements of the gas turbine engine will expand and contract at different rates and can also expand toward each other. To prevent the different components from coming into contact with each other the clearance distance between the rotating and static components is adjusted by moving the rotating component axially in either the forward or aft direction.

Figure 2A:
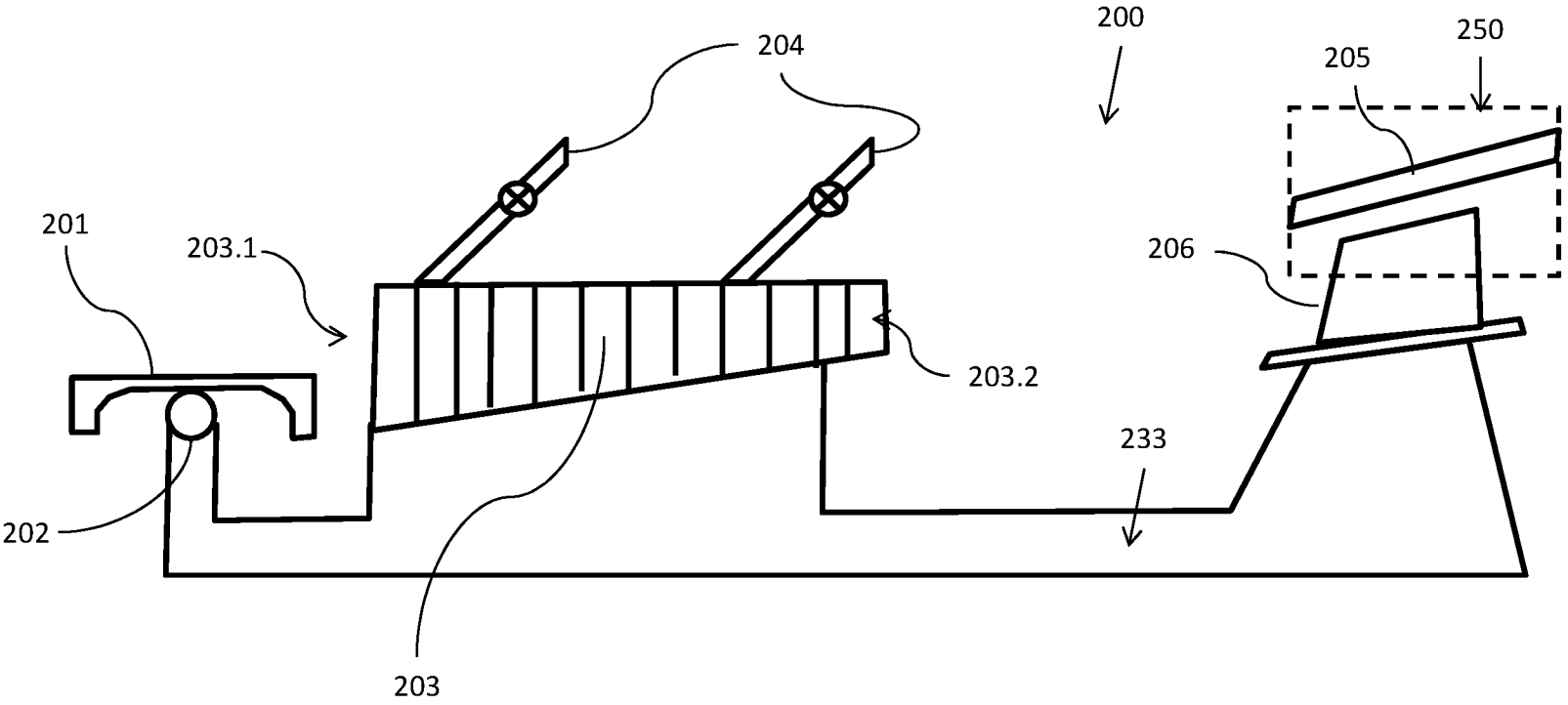
FIG. 2A illustrates a schematic cross-sectional view of a rotating component and portions of a static component of a gas turbine engine in accordance with one or more exemplary embodiments.

For example, FIG. 2A illustrates a schematic cross-sectional view of a rotating component 233 and portions of a static component of a gas turbine engine 200 in accordance with one or more exemplary embodiments. The rotating component includes a thrust bearing 202, a compressor 203, and a turbine 206. The compressor 203 has a forward end 203.1 and an aft end 203.2. The portions of the static component that are shown include the bearing portion 201, thrust balance vents 204, and a static wall 205. As shown the compressor 203 includes chambers between discs that the thrust balance vents 204 can selectively vent. It can be appreciated that when a chamber toward the forward end 203.1 of the compressor 203 is vented a force is generated that can axially shift the rotating component in the forward direction. Further, when a chamber toward the aft end 203.1 of the compressor 203 is vented a force is generated that can axially shift the rotating component in the aft direction. This shift can be used to keep components from touching when they grow, by either expanding or contracting, due to mechanical or thermal forces.

Figure 2B:
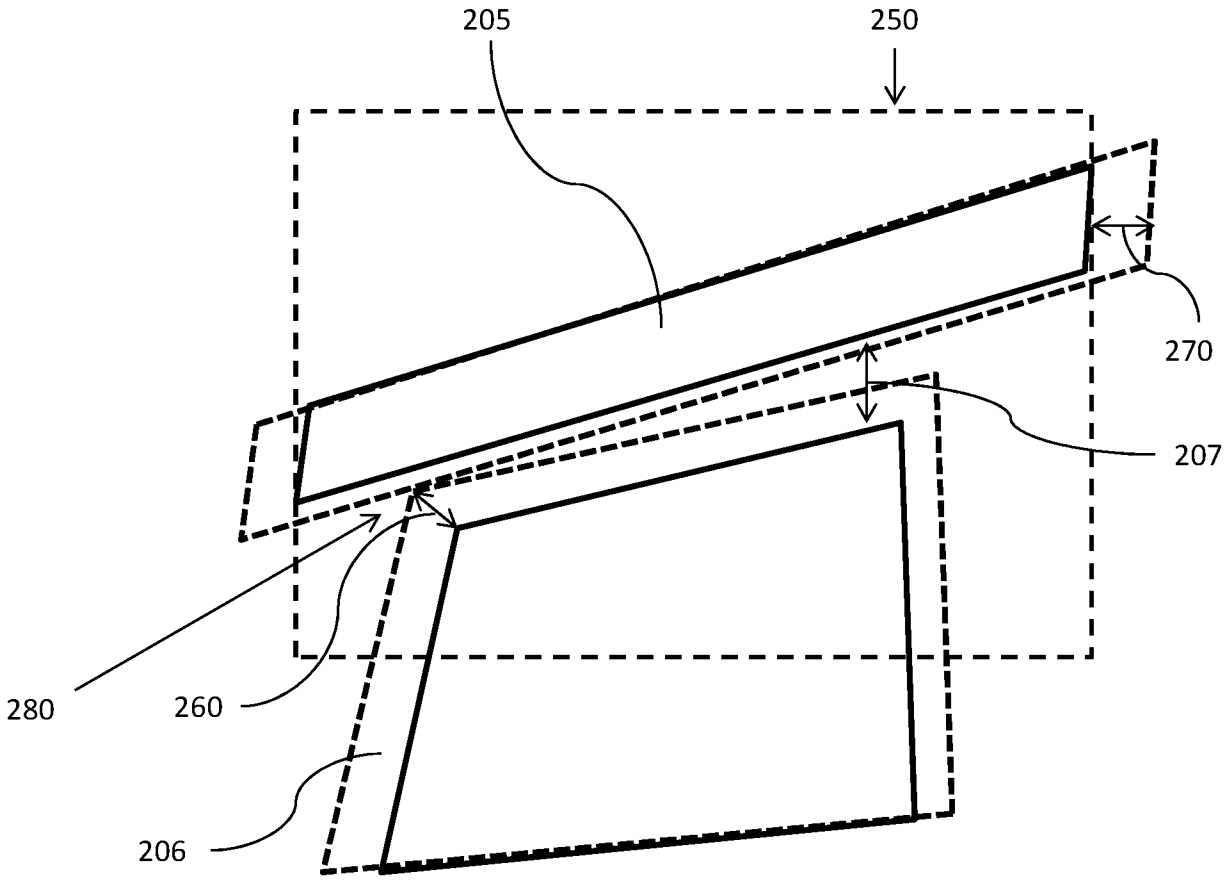
FIG. 2B illustrates a schematic cross-sectional view of a portion of the rotating component and a portion of the static component, from indicator box 250 of FIG. 2A, of a gas turbine engine in accordance with one or more exemplary embodiments.

FIG. 2B illustrates a schematic cross-sectional view of a portion of the rotating component 206 and a portion of the static component 205, from indicator box 250 of FIG. 2A, of a gas turbine engine 200 in accordance with one or more exemplary embodiments. As shown the static wall 205, which is the portion of the static component 205, can expand as shown a distance 270 outward and toward the rotating component 206. Additionally, the rotating component 206, which may be a turbine 206, can expand outward a distance 260. Further, if both components expand during a transient period the components could come in contact as shown at point 280. This contact is undesirable. Thus, the original clearance 207 can be reduced due to the growth of either component 205, 206. Thus, in order to avoid the loss of clearance and possible contact between components, the components are shifted to create a change in the clearance distance 207.

Figure 3A:
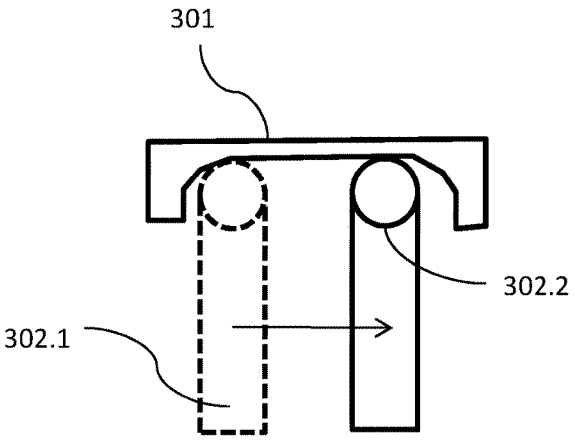
FIG. 3A illustrates a schematic cross-sectional view of a portion of a bearing assembly of the rotating component axially shifting in an aft direction and the static component in accordance with one or more exemplary embodiments.

FIG. 3A illustrates a schematic cross-sectional view of a portion 302 of a bearing assembly of the rotating component axially shifting in an aft direction and the static component 301 in accordance with one or more exemplary embodiments. Specifically, as shown, a bearing assembly is shifted from a forward loaded position 302.1 to an aft position 302.2. This is provided because of the built-in bearing freeplay within the bearing assembly that provided an axial distance along which the bearing assembly can travel. In response to this axial shift, the other components of the rotating component also shift the same distance.

Figure 3B:
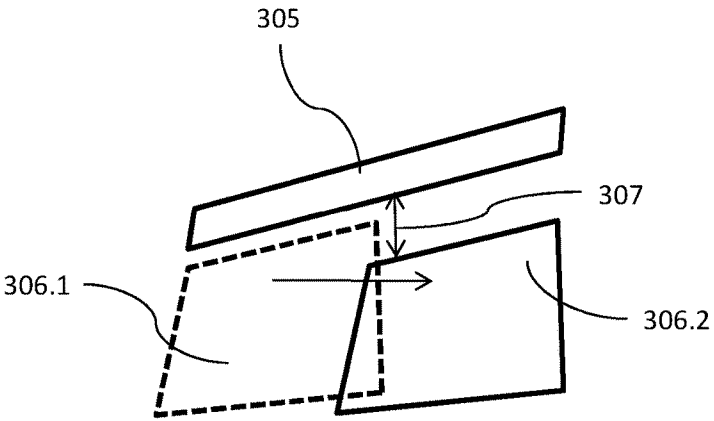
FIG. 3B illustrates a schematic cross-sectional view of a portion of the rotating component axially shifting in an aft direction and the static component in accordance with one or more exemplary embodiments.

For example, FIG. 3B illustrates a schematic cross-sectional view of a portion of the rotating component axially shifting in an aft direction in accordance with one or more exemplary embodiments. As shown the rotating portion is axially shifted in the aft direction in a similar manner to that shown in FIG. 3A. Particularly the rotating component moves from a forward position 306.1 to an aft position 306.2. Further, the static component 305 remains in its original position. Thus, a clearance distance 307 increases between the components when the rotating component shifts from the forward position 306.1 to the aft position 306.2 during a transient period when growth values of the components are expanding and contracting.

Figure 4A:
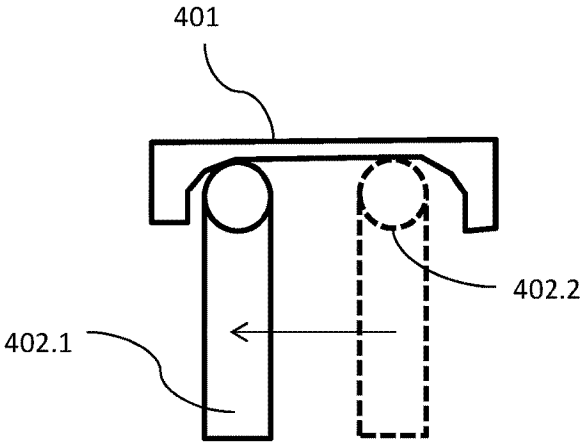
FIG. 4A illustrates a schematic cross-sectional view of a portion of a bearing assembly of the rotating component axially shifting in a forward direction and the static component in accordance with one or more exemplary embodiments.

FIG. 4A illustrates a schematic cross-sectional view of a portion of a bearing assembly of the rotating component axially shifting in a forward direction in accordance with one or more exemplary embodiments. Specifically, as shown, a bearing assembly is shifted from an aft position 402.2 to a forward loaded position 402.1. This is provided because of the built-in bearing freeplay within the bearing assembly that provided an axial distance along which the bearing assembly can travel. In response to this axial shift, the other components of the rotating component also shift the same distance.

Figure 4B:
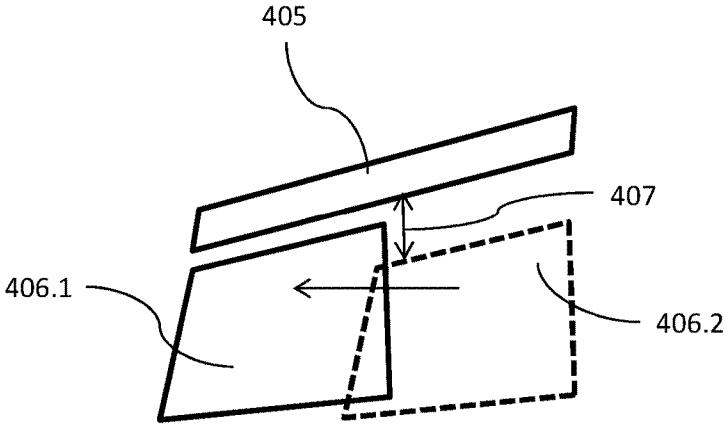
FIG. 4B illustrates a schematic cross-sectional view of a portion of the rotating component axially shifting in a forward direction and the static component in accordance with one or more exemplary embodiments.

For example, FIG. 4B illustrates a schematic cross-sectional view of a portion of the rotating component axially shifting in a forward direction in accordance with one or more exemplary embodiments. As shown the rotating portion is axially shifted in the forward direction in a similar manner to that shown in FIG. 4A. Particularly the rotating component moves from an aft position 406.2 to a forward position 406.1. Further, the static component 405 remains in its original position. Thus, a clearance distance 407 decreases between the components when the rotating component shifts from the aft position 406.2 to the forward position 406.1 during a growth normalized period of operation.

Figure 5:
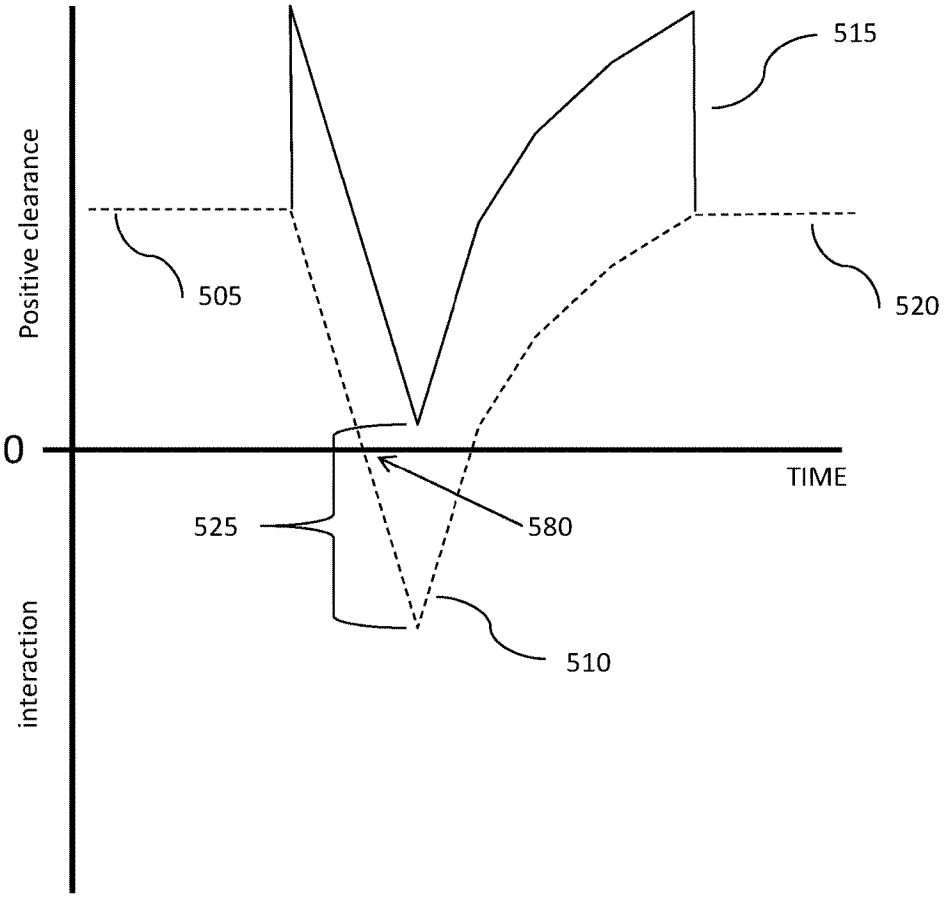
FIG. 5 illustrates a graphical view of a clearance distance over time between a rotating component and a static component of a gas turbine engine in accordance with one or more exemplary embodiments.

FIG. 5 illustrates a graphical view of a clearance distance over time between a rotating component and a static component of a gas turbine engine in accordance with one or more exemplary embodiments. Specifically, the dotted line 505 shows a clearance distance between a static component and a rotating component in steady state operation before the beginning of the transient event. Following that line to the point where the gas turbine engine transient begins causes it to sharply descend on the graph as the parts come closer together during a transient period when the parts of expanding toward each other. As shown, if left to expand the distance between the components can cause the components to come into contact 580 causing interaction and irrecoverable deterioration, which is undesirable. The gas turbine engine static and rotating components will begin to normalize and the growth due to mechanical and thermal forces will begin to normalize as indicated by the rising curve 510 until the engine reaches an active operating period of normal operation as shown at point 520. The component shift that can shift the clearance value by axially moving the rotating component in relation to the static component is shown by the line 515. As shown, the rotating portion can be axially shifted increasing the clearance distance during the transient period avoiding any contact between the components. Then, once the components reach steady state operation, the rotating component can again be axially shifted back adjusting the clearance distance to a desired operating distance.

Figure 6:
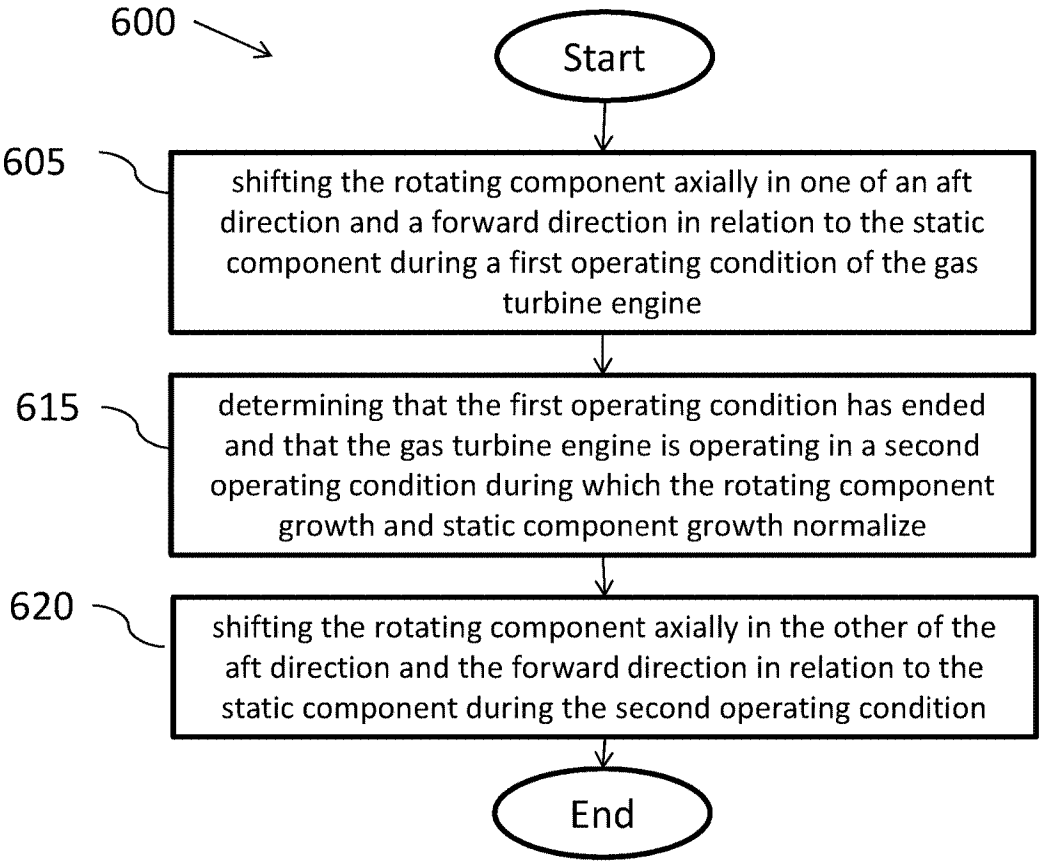
FIG. 6 illustrates a flowchart of a method for clearance control between a rotating component and a static component of a gas turbine engine in accordance with one or more exemplary embodiments.

FIG. 6 illustrates a flowchart of a method 600 for clearance control between a rotating component and a static component of a gas turbine engine in accordance with one or more exemplary embodiments. The method 600 includes shifting the rotating component axially in one of an aft direction and a forward direction in relation to the static component during a first operating condition of the gas turbine engine (operation 605). The first operating condition is when a rotating component growth and a static component growth change at different rates. The method 600 also includes determining that the first operating condition has ended and that the gas turbine engine is operating in a second operating condition during which the rotating component growth and static component growth normalize (operation 615). Further the method 600 includes shifting the rotating component axially in the other of the aft direction and the forward direction in relation to the static component during the second operating condition (operation 620).

According to another embodiment, shifting the rotating component axially in the aft direction includes increasing a clearance distance between the rotating component and the static component. Further, shifting the rotating component axially in the forward direction includes decreasing the clearance distance between the rotating component and the static component. Further, the method includes maintaining the clearance distance within a max threshold value and a minimum threshold value.

According to another embodiment, a backward most position in the aft direction and a forward most position in the forward direction have a maximum separation distance defined by a thrust bearing freeplay distance. According to another embodiment, the rotating component includes a high spool that includes a compressor and a turbine. According to another embodiment, the static component growth and the rotating component growth each include a mechanical expansion value and a thermal expansion value.

According to another embodiment, shifting the rotating component axially includes manipulating thrust balance in a compressor of the gas turbine engine. Manipulating the thrust balance further includes venting certain parts of the compressor using thrust balance vents. Further, venting generates axial force within the compressor that shifts the rotating component axially. According to another embodiment, the compressor includes a plurality of rotating disks with a chamber between each of the plurality of rotating disks. Additionally, a lower pressure is provided in the chamber on a forward side of each rotating disk and a higher pressure is provided in the chamber on an aft side of each rotating disk. According to another embodiment, the method can further include venting a higher pressure chamber axially shifting the rotating component in the aft direction. Alternatively, the method includes venting a lower pressure chamber axially shifting the rotating component in the forward direction.

According to one or more embodiments, clearances between rotating airfoils and static walls are critical for efficient engine operation. They are driven by both thermal and mechanical deflections. Mechanical deflections happen essentially instantly with throttle movement, well before thermal deflections. This means mechanically driven pinches in clearance values set minimum running clearances, meaning that steady state running positions are open by some amount. This sacrifices steady state performance in order to protect against mechanically driven transient pinches.

One or more embodiments use thrust balance modulation, in conjunction with an axially sloped flow path, to manipulate axial rotor position in response to transient throttle excursions. By doing this, clearances can be manipulated on the same order of time magnitude as the mechanical deflections. Allowing the rotor to move backwards (increasing clearance) as the transient occurs, providing additional room to allow the mechanical growths to pass, before readjusting thrust balance to move the rotor back to the tighter steady state position as thermals stabilize.

One or more embodiments include a system in a gas turbine engine for clearance control. The system includes a gas turbine engine controller that generates a clearance control signal based on an operating period of the system, wherein the control signal controls axial shifts within the system. The system also includes a static component, and a rotating component that shifts axially in an aft direction in relation to the static component during a transient period of operation of the gas turbine engine in response to receiving the clearance control signal, and shifts axially in a forward direction in relation to the static component during a normal period in response to receiving the clearance control signal. The transient period is when a rotating component growth and a static component growth change at different rates, and the normal period is when the rotating component growth and static component growth normalize.

One or more embodiments, allow steady state operation to achieve tighter running clearances but still maintain similar levels of transient protection. Overall this would help achieve a more efficient cruise segment and limit climb/throttle transient induced deterioration.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description has been presented for purposes of illustration and description, but is not intended to be exhaustive or limited to the embodiments in the form disclosed. Many modifications and variations will be apparent to those of ordinary skill in the art without departing from the scope of the disclosure. The embodiments were chosen and described in order to best explain the principles of the disclosure and the practical application, and to enable others of ordinary skill in the art to understand various embodiments with various modifications as are suited to the particular use contemplated.

The present embodiments may be a system, a method, and/or a computer program product at any possible technical detail level of integration. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may include copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Java, Smalltalk, C++, or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to embodiments. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments have been presented for purposes of illustration, but are not intended to be exhaustive or limited to the embodiments disclosed. Many modifications and variations will be apparent to those of ordinary skill in the art without departing from the scope of the described embodiments. The terminology used herein was chosen to best explain the principles of the embodiments, the practical application or technical improvement over technologies found in the marketplace, or to enable others of ordinary skill in the art to understand the embodiments disclosed herein.

Accordingly, the present disclosure is not to be seen as limited by the foregoing description, but is only limited by the scope of the appended claims.

What is claimed is:

1. A gas turbine engine with clearance control, the gas turbine engine comprising:

a static component coupled to the gas turbine engine at a first location and configured to expand and contract without moving from the first location; and a rotating component that shifts axially in one of an aft direction and a forward direction in relation to the static component that is maintained at the first location during a first operating condition of the gas turbine engine, and shifts axially in the other of the aft direction and the forward direction in relation to the static component that is maintained at the first location during a second operating condition of the gas turbine engine, wherein the first operating condition is when a rotating component growth and a static component growth change at different rates in response to at least one of an expansion and a contraction, and wherein the second operating condition is when the rotating component growth and static component growth normalize.

2. The gas turbine engine of claim 1, wherein the rotating component increases a clearance distance between the rotating component and the static component by shifting axially in the first operating condition; and wherein the rotating component decreases the clearance distance between the rotating component and the static component by shifting axially in the second operating condition.

3. The gas turbine engine of claim 1, wherein a backward most position in the aft direction and a forward most position in the forward direction have a maximum separation distance defined by a thrust bearing freeplay distance.

4. The gas turbine engine of claim 1, wherein the static component growth and the rotating component growth each include a mechanical expansion value and a thermal expansion value.

5. The gas turbine engine of claim 1, further comprising:

a compressor that manipulates thrust balance within the compressor that shifts the rotating component axially.

6. The gas turbine engine of claim 5, further comprising:

thrust balance vents that vent certain parts of the compressor, wherein venting generates axial force within the compressor that shifts the rotating component axially.

7. The gas turbine engine of claim 6, wherein the compressor comprises a plurality of rotating disks with a chamber between each of the plurality of rotating disks, and wherein the chamber on a forward side of each rotating disk has a lower pressure than the chamber on an aft side of each rotating disk that has a higher pressure.

8. The gas turbine engine of claim 7, further comprising:

a higher pressure chamber that axially shifts the rotating component in the aft direction when the higher pressure chamber is vented; and a lower pressure chamber that axially shifts the rotating component in the forward direction when the lower pressure chamber is vented.

9. A system in a gas turbine engine for clearance control, the system comprising:

a gas turbine engine controller including a computer processor, the gas turbine engine controller configured to determine first and second operating conditions, and that generates a clearance control signal based on operating conditions of the gas turbine engine, wherein the control signal controls axial shifts within the system;

a static component coupled to the gas turbine engine at a first location and configured to expand and contract without moving from the first location; and a rotating component coupled to the gas turbine engine at a second location and that shifts axially in one of an aft direction and a forward direction in relation to the static component that is maintained at the first location during a first operating condition of the gas turbine engine in response to receiving the clearance control signal, and shifts axially in the other of the aft direction and the forward direction in relation to the static component that is maintained at the first location during a second operating condition of the gas turbine engine in response to receiving the clearance control signal, wherein the first operating condition is when a rotating component growth and a static component growth change at different rates in response to at least one of an expansion and a contraction, and wherein the second operating condition is when the rotating component growth and static component growth normalize.

10. A method for clearance control between a rotating component and a static component of a gas turbine engine, the method comprising:

coupling the static component to the gas turbine engine at a first location, the static component configured to expand and contract without moving from the first location;

shifting the rotating component axially in one of an aft direction and a forward direction in relation to the static component during a first operating condition of the gas turbine engine, wherein the first operating condition is when a rotating component growth and a static component growth change at different rates in response to at least one of an expansion and a contraction;

determining that the first operating condition has ended and that the gas turbine engine is operating in a second operating condition during which the rotating component growth and static component growth normalize; and shifting the rotating component axially in the other of the aft direction and the forward direction in relation to the static component that is maintained at the first location during the second operating condition.

11. The method of claim 10, wherein shifting the rotating component axially in the aft direction comprises:

increasing a clearance distance between the rotating component and the static component, and wherein shifting the rotating component axially in the forward direction comprises:

decreasing the clearance distance between the rotating component and the static component.

12. The method of claim 11, further comprising:

maintaining the clearance distance within a max threshold value and a minimum threshold value.

13. The method of claim 11, wherein a backward most position in the aft direction and a forward most position in the forward direction have a maximum separation distance defined by a thrust bearing freeplay distance.

14. The method of claim 11, wherein the rotating component comprises a high spool that includes a compressor and a turbine.

15. The method of claim 11, wherein the static component growth and the rotating component growth each include a mechanical expansion value and a thermal expansion value.

16. The method of claim 11, wherein shifting the rotating component axially comprises:

manipulating thrust balance in a compressor of the gas turbine engine.

17. The method of claim 16, wherein manipulating the thrust balance comprises:

venting certain parts of the compressor using thrust balance vents, wherein venting generates axial force within the compressor that shifts the rotating component axially.

18. The method of claim 17, wherein the compressor comprises a plurality of rotating disks with a chamber between each of the plurality of rotating disks, wherein a lower pressure is provided in the chamber on a forward side of each rotating disk and a higher pressure is provided in the chamber on an aft side of each rotating disk.

19. The method of claim 18, further comprising:

venting a higher pressure chamber by axially shifting the rotating component in the aft direction.

20. The method of claim 18, further comprising:

venting a lower pressure chamber by axially shifting the rotating component in the forward direction.

* * * * *